US007641516B1

(12) United States Patent
Scott et al.

(10) Patent No.: US 7,641,516 B1
(45) Date of Patent: Jan. 5, 2010

(54) ELECTRICAL CONNECTOR

(75) Inventors: Jason Scott, Webster, NY (US); Timothy D. Rountree, East Rochester, NY (US); Joshua Storm Gannon, Fairport, NY (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 12/233,772

(22) Filed: Sep. 19, 2008

(51) Int. Cl.
*H01R 13/648* (2006.01)

(52) U.S. Cl. ..... 439/607.12; 439/95; 439/700

(58) Field of Classification Search ..... 439/607.12, 439/95, 700, 101, 824
See application file for complete search history.

(56) References Cited

U.S. PATENT DOCUMENTS

| | | | | | |
|---|---|---|---|---|---|
| 3,670,292 | A * | 6/1972 | Tracy | 439/607.12 |
| 4,126,370 | A * | 11/1978 | Nijman | 439/607.12 |
| 4,186,983 | A | 2/1980 | Kaye | |
| 4,275,945 | A * | 6/1981 | Krantz et al. | 439/607.12 |
| 4,288,504 | A | 9/1981 | Julian et al. | |
| 4,407,552 | A * | 10/1983 | Watanabe et al. | 439/607.12 |
| 4,519,665 | A * | 5/1985 | Althouse et al. | 439/607.02 |
| 4,588,242 | A | 5/1986 | McDowell et al. | |
| 4,624,515 | A * | 11/1986 | Brush et al. | 439/95 |
| 4,737,116 | A * | 4/1988 | Slye et al. | 439/92 |
| 5,092,788 | A | 3/1992 | Pristupa, Jr. et al. | |
| 5,127,849 | A | 7/1992 | Karl et al. | |
| 5,213,521 | A * | 5/1993 | Arisaka | 439/607.12 |
| 5,823,811 | A | 10/1998 | Blanchfield et al. | |
| 6,780,068 | B2 * | 8/2004 | Bartholoma et al. | 439/752 |
| 7,247,053 | B2 * | 7/2007 | Yamagata | 439/607.53 |

* cited by examiner

*Primary Examiner*—Gary F. Paumen
(74) *Attorney, Agent, or Firm*—Darby & Darby PC; Robert J. Sacco

(57) ABSTRACT

A connector (200) is provided that comprises a dielectric body (DB), pins (302), and a plate (800). Each pin is captured within DB (404) so as to extend therethrough. Each pin is defined by a pair of nubs (410, 510) extending from DB's opposing faces (408, 604), respectively. Each nub is movable along an axis aligned with an elongated length of the pin. The plate is formed of a planar conductive material secured to DB adjacent to a first opposing face. The plate comprises apertures through which the pins extend in a first direction. At least one aperture is sized and shaped to form an electrical connection between the plate and selected pins. Resilient spring fingers (RSF) are formed on a periphery of the plate. Each RSF (1006) extends away from DB in a direction between a plane defined by the first opposing face and first direction of the pins.

20 Claims, 7 Drawing Sheets

ELECTRICAL CONNECTOR

BACKGROUND OF THE INVENTION

1. Statement of the Technical Field

The invention concerns electrical connectors. More particularly, the invention concerns low impedance, low profile battery connectors configured for electrically connecting a battery to at least one circuit.

2. Description of the Related Art

There are many battery connectors known in the art for electrically connecting circuits to a battery. Such battery connectors include, but are not limited to, an electrical connector assembly disclosed in U.S. Pat. No. 5,092,788 to Pristupa, Jr. et al. (hereinafter referred to as "Pristupa"). The electrical connector assembly of Pristupa generally comprises an electrical connector configured to be captivated by a radio housing and a battery housing. In this regard, it should be understood that a universal connector is located on the back of the radio for engaging the electrical connector.

The universal connector is comprised of nine (9) electrical contacts having a grid configuration. The electrical contacts extend away from the radio housing. Four (4) protruding members are also located on the back of the radio housing. The protruding members facilitate an alignment of the electrical connector and the universal connector.

The electrical connector is comprised of an interface section having a plurality of pads formed thereon. Each of the pads is configured to engage one of the electrical contacts of the universal connector. The electrical connector is also comprised of a plurality of apertures formed therein. The apertures facilitate the captivation of the electrical connector by the radio housing. As such, the apertures are sized and shaped to receive the protruding members of the universal connector.

The electrical connector assembly of Pristupa suffers from certain drawbacks. For example, the electrical connector assembly has a relatively large profile. The electrical connector assembly has a relatively complicated assembly. Accordingly, there is a need for an electrical connector having a low profile and easy assembly.

SUMMARY OF THE INVENTION

The present invention concerns a low impedance, low-profile connector. The connector comprises a dielectric body comprising two opposing faces, pins, a plate, and resilient spring fingers. Each pin is formed of a conductive material captured within the dielectric body. Each pin extends through the dielectric body. Each pin is defined by a pair of nubs. The nubs respectively extend from each of the two opposing faces. Each nub is movable along an axis aligned with an elongated length of the pin. Each nub is resiliently biased in a direction away from the two opposing faces.

The plate is formed of a planar conductive material. The plate is secured to the dielectric body adjacent to a first face of the two opposing faces. The plate comprises one or more apertures through which the pins extend in a first direction. One or more of the apertures is sized and shaped to form an electrical connection between the plate and selected ones of the pins. The selected pins can be ground pins having a longer length as compared to a remainder of the pins. The resilient spring fingers comprise projections formed on a periphery of the plate. Each of the resilient spring fingers extends away from the dielectric body in a direction between a plane defined by the first face and the first direction of the pins. Notably, an end of the resilient spring fingers distal from the dielectric body is approximately aligned with an end of the nubs distal from the dielectric body.

According to an aspect of the invention, retention fingers are formed as projections on a periphery of the plate. Each of the retention fingers is shaped to define a resilient clip configured for engaging a portion of the dielectric body. For example, the resilient spring fingers have an S-shaped profile. The portion of the dielectric body is a ridge defined on a peripheral portion of the dielectric body adjacent to the first face of the two opposing faces. Retainers are formed of tab-like projections defined on a periphery of the plate. The retainers extend beyond a peripheral edge of the dielectric body. The retainers are configured for securing the connector to a chassis.

According to another aspect of the invention, the dielectric body is comprised of at least one sidewall extending from the first face to a second opposing face. At least one gasket is provided on the sidewall. The gasket is configured for forming a seal which prevents the intrusion of environmental contaminants around a periphery of the connector when the connector is installed in a chassis. The dielectric body is further comprised of an alignment key structure. The alignment key structure is configured for selectively limiting an installed position of the connector within the chassis in which it is to be installed.

BRIEF DESCRIPTION OF THE DRAWINGS

Embodiments will be described with reference to the following drawing figures, in which like numerals represent like items throughout the figures, and in which.

DETAILED DESCRIPTION OF THE PREFERRED EMBODIMENTS

Embodiments of the present invention will now be described with respect to FIGS. 1-10. Embodiments of the present invention relate to electrical connectors. The electrical connectors are compact, versatile connectors configured to interface between a circuit and at least one power source (e.g., a battery and a battery eliminator). The electrical connectors advantageously comprise low profile, double-sided electrically conductive pins. Double-sided electrically conductive pins advantageously have contact surfaces on two opposing ends for facilitating an electrical connection between a circuit and at least one power source. Low impedance electrical connections are provided between circuits and power sources via the electrically conductive pins.

The electrical connectors comprise gaskets configured to form immersion seals between the electrical connectors and surrounding structures (e.g., sidewalls of holes bored into casings of a handheld communication device). The immersion seals are environmental seals configured to prevent moisture from seeping into the electrical connector. The electrical connectors can be inserted into apertures (or bored holes) formed in casings of electronic devices (e.g., a handheld communication device) without using insertion tools. The electrical connectors can be retained within electronic devices (e.g., a handheld communication device) without using retaining structures (e.g., threaded fasteners).

Before describing the low impedance, low-profile connectors of the present invention, it will be helpful in understanding an exemplary environment in which the invention can be utilized. In this regard, it should be understood that the low impedance, low-profile connectors of the present invention can be utilized in a variety of different applications where circuits need to be electrically connected to one or more power sources. Such applications include, but are not limited to, radio applications, mobile/cellular telephone applications, and other communication device applications.

Figure 1:
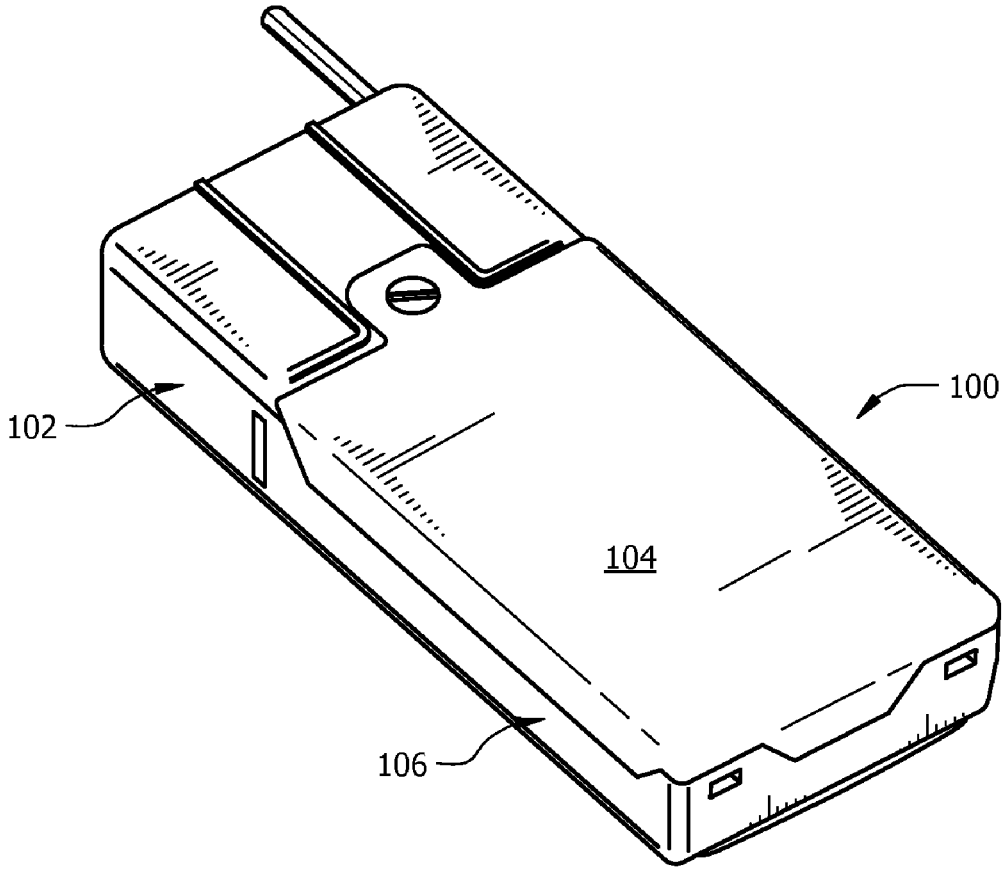
FIG. 1 is a back perspective view of an exemplary communication device that is useful for understanding the present invention.

Referring now to FIG. 1, there is provided a back perspective view of an exemplary communication device 100 that is useful for understanding the present invention. Communication device 100 can be a handheld radio, a mobile telephone, a cellular phone, or any other portable communication device known to those having ordinary skill in the art. As shown in FIG. 1, communication device 100 is generally comprised of a housing 102 configured to house circuits (not shown), batteries (not shown), and other electronic components (not shown). Housing 102 is comprised of a main body 106 and a battery cover 104. The battery cover 104 is a removable component facilitating the insertion of a battery (not shown) into the communications device 100. The battery cover 104 also facilitates the removal of the battery (not shown) from the communication device 100. This battery removal is accomplished by the de-coupling of the battery cover 104 from the electronic device 100. As a result of the battery cover decoupling, a user (not shown) has access to the battery (not shown) for removal of the same.

Figure 2:
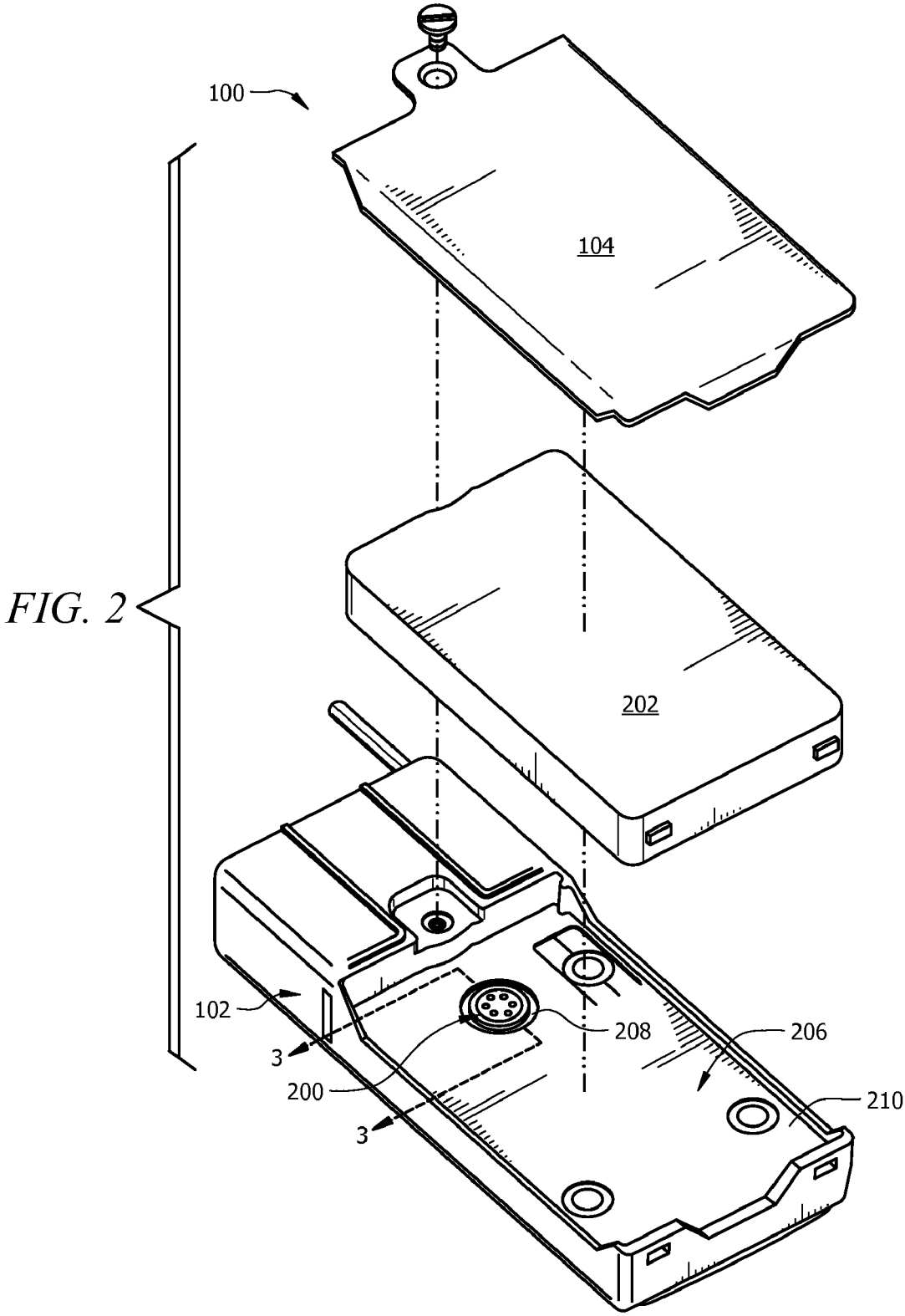
FIG. 2 is a back perspective view of the communication device of FIG. 1 with a battery cover and battery removed therefrom.
Figure 3:
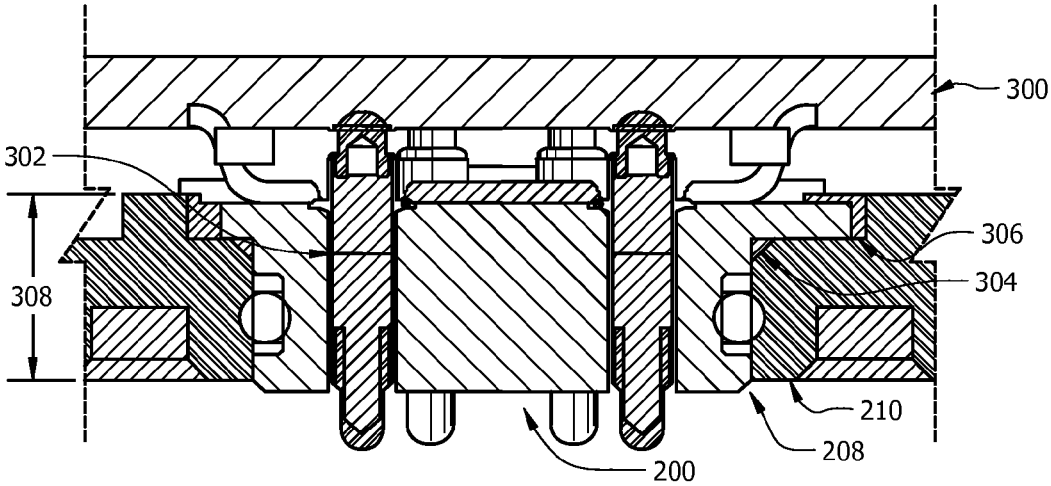
FIG. 3 is a cross sectional view of a portion of the communications device taken along line 3-3 of FIG. 2.

Referring now to FIG. 2, there is provided a back perspective view of communication device 100 having the battery cover 104 and battery 202 removed therefrom. In FIG. 3, there is provided a cross sectional view of a portion of the communications device 100 taken along line 3-3 of FIG. 2. As shown in FIGS. 2-3, the communication device 100 is comprised of a low impedance, low profile electrical connector 200. Electrical connector 200 is disposed within an aperture (or bored hole) 208 formed in a bottom wall 210 of a battery compartment 206. Aperture (or bored hole) 208 is sized and shaped to snuggly receive electrical connector 200. According to an embodiment of the invention, the aperture (or bored hole) 208 has a diameter less than 0.650 inches. Bottom wall 210 has a thickness 308 less than 0.209 inch. The invention is not limited in this regard.

During assembly, the electrical connector 200 is pressed into the aperture (or bored hole) 208 without using an insertion tool. The electrical connector 200 is retained in the aperture (or bored hole) 208 without using retaining structures (e.g., threaded fasteners). The electrical connector 200 is generally configured to interface between the battery 202 and a circuit (not shown) printed on a printed circuit board 300 disposed within the communication device 100. In one non-limiting embodiment of the invention, the electrical connector 200 comprises six (6) electrically conductive pins 302. The electrically conductive pins 302 are selected to comprise, two (2) ground pins, two (2) power pins, and two (2) signal pins. The electrical connector 200 will be described further in relation to FIGS. 4-10.

It should be noted that the bottom wall 210 comprises a guide 304 and a stop ledge 306. The guide 304 ensures proper alignment of the electrical connector 200 and bottom wall 210. The guide 304 can be defined by a chamfered edge of the bottom wall 210 having a value between fifteen and seventy degrees (15°-70°). The shape of the chamfered edge can be annular or any other shape selected in accordance with a particular electrical connector application. The stop ledge 306 ensures that the electrical connector 200 is inserted a pre-defined distance into the aperture (or bored hole) 208.

Figure 4:
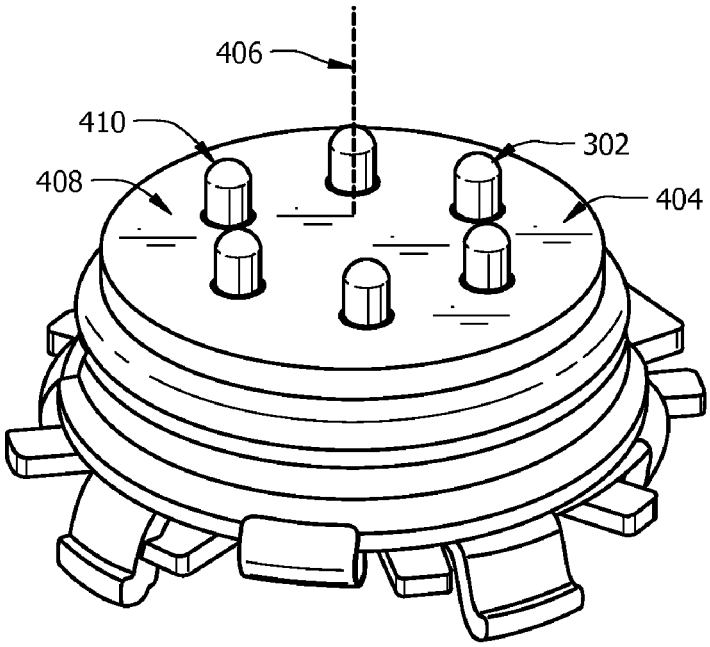
FIG. 4 is a perspective view of a top of the low impedance, low-profile connector shown in FIGS. 2-3 that is useful for understanding the invention.
Figure 5:
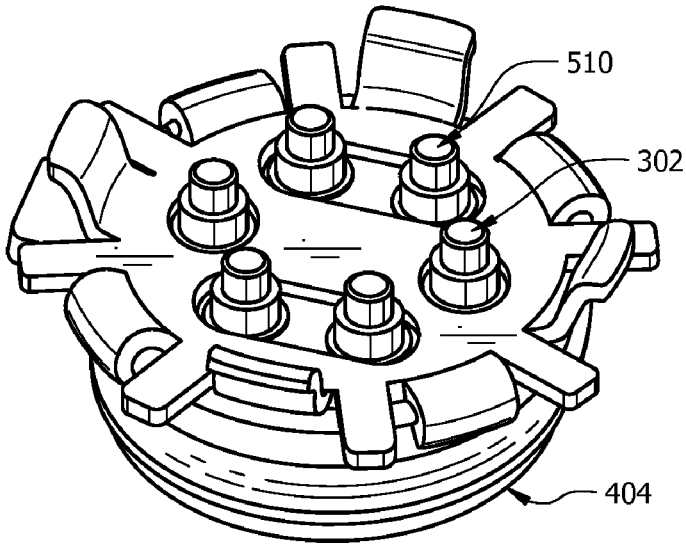
FIG. 5 is a perspective view of a bottom of the low impedance, low-profile connector shown in FIGS. 2-3 that is useful for understanding the invention.

Referring now to FIG. 4, there is provided a perspective view of the top of the electrical connector 200. A perspective view of the bottom of the electrical connector 200 is provided in FIG. 5. The electrical connector 200 generally has an operating temperature range of negative forty degrees Celsius to eighty-five degrees Celsius (−45° C. to 85° C.). Notably, the electrical connector 200 advantageously meets MIL-STD-810F environmental standards. The MIL-STD-810F standards are well known to those having ordinary skill in the art, and therefore will not be described herein. However, it should be understood that the electrical connector 200 operates under harsh environmental conditions.

Referring again to FIG. 4, the electrical connector 200 is generally shown by a plurality of electrically conductive pins 302 integrated within a dielectric body 404. As shown in FIG. 4, the electrical connector 200 is comprised of six (6) radially spaced electrically conductive pins 302. The invention is not limited in this regard. For example, the electrical connector 200 can include any number of electrically conductive pins 302 in any arrangement selected in accordance with a particular multi-pin electrical connection application.

According to an embodiment of the invention, the electrically conductive pins 302 are manually integrated within the dielectric body 404 having a generally cylindrical form. In such a scenario, the electrically conductive pins 302 are pressed into apertures of the dielectric body 404 during assembly. According to another embodiment of the invention, the electrically conductive pins 302 are integrally molded within the dielectric body 404 during an injection molding process. Injection molding processes are well known to those having ordinary skill in the art, and therefore will not be described herein. Any known injection molding process can be used to form the dielectric body 404 with integrated electrically conductive pins 302.

Referring again to FIGS. 4-5, the electrically conductive pins 302 are of the same type and have cylindrical shapes. For example, the electrically conductive pins 302 comprise double-sided pogo pins available from Interconnect Devices, Inc., of Kansas City, Kans. The pogo pins can have a resistance less than or equal to ten (10) milli Ohms. The pogo pins can have a current rating greater than or equal to five (5) amps continuous. A double sided pogo pin typically includes a pair of nubs 410, 510 on two (2) opposing ends thereof. Each nub 410, 510 defines a contact surface that is movable along an axis aligned with an elongated length of a pogo pin. The pogo pin also includes at least one chamber with at least one spring disposed therein. The spring resiliently biases at least one nub 410, 510 of the pair of nubs in a direction away from the other nub. When the pogo pin is actuated, the spring is compressed. In effect, the length of the pogo pin is decreased. The invention is not limited in this regard. However, it should be understood that electrically conductive pins 302 are advantageously selected to provide low impedance connections between power sources (e.g., battery 202 of FIG. 2) and a circuit (not shown) printed on printed circuit board 300 disposed within communication device 100.

Referring again to FIGS. 4-5, dielectric body 404 securely retains the electrically conductive pins 302 in pre-defined positions. In this regard, it should be understood that the electrically conductive pins 302 are arranged in a parallel type configuration. Each of the electrically conductive pins 302 is also arranged so that its vertical axis 406 is generally perpendicular to a plane defined by a first surface 408 of two opposing surfaces of the dielectric body 404.

The dielectric body 404 can be a single piece molded component having electrically conductive pins 302 inserted or integrally molded therein. The dielectric body 404 is generally formed from a dielectric material. Such dielectric materials include, but are not limited to, polymers, rubbers, and plastics. The dielectric body 404 can be formed utilizing any suitable process known to those having ordinary skill in the art. Such processes include, but are not limited to, molding processes and deposition-etch back processes.

Figure 6:
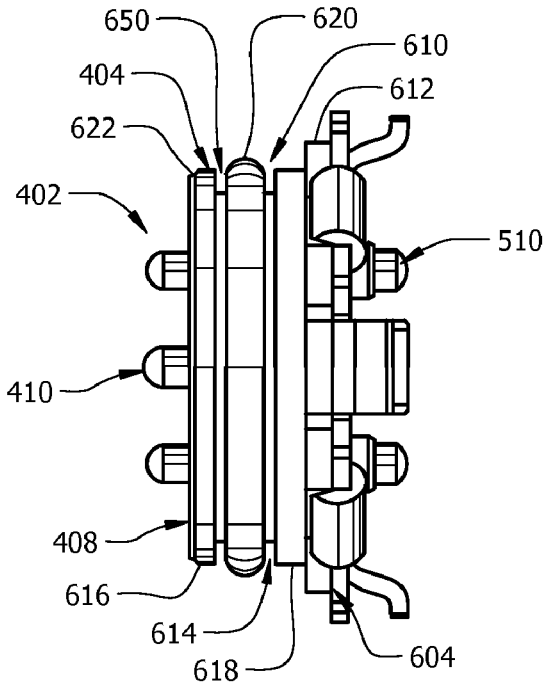
FIG. 6 is a side view of the low impedance, low-profile connector shown in FIGS. 2-3 that is useful for understanding the invention.

Referring now to FIG. 6, there is provided a side view of the electrical connector 200. As shown in FIG. 6, the electrically conductive pins 302 are partially disposed within the dielectric body 404 so as to extend therethrough. In effect, a first nub (or contact portion) 410 of each pin 302 extends beyond a first surface (or face) 408 of the dielectric body 404. Similarly, a second nub (or contact portion) 510 of each pin 302 extends beyond a second surface (or face) 604 of the dielectric body 404, wherein the second surface (or face) 604 is opposed from the first surface (or face) 408. At least one of the first nubs 410 is provided to engage electrically conductive pads/contacts of at least one power source (e.g., battery 202 of FIG. 2) for joining the power source(s) and a circuit (not shown) together. At least one of the second nubs 510 is provided to engage electrically conductive pads/contacts of a circuit (not shown). More particularly, the second nub 510 can be provided to engage conductive pads of the printed circuit board 300 (described above in relation to FIG. 3) for joining the circuit (not shown) and at least one power source (e.g., battery 202 of FIG. 2) together.

The dielectric body 404 is comprised of a main body 610 and a protruding end 612. The main body 610 comprises a sidewall 650, a groove 614, a first retaining structure 616, and a second retaining structure 618. The sidewall 650 extends from the first surface (or face) 408 to the second surface (or face) 604 thereof. The groove 614 is sized and shaped for receiving a gasket 620 having a loop-like shape and a central aperture. The retaining structures 616, 618 are sized and shaped for preventing the gasket 620 from being dislodged from the groove 614. According to an embodiment of the invention, the gasket 620 is an o-ring gasket. In such a scenario, the groove 614 is an o-ring groove sized and shaped to receive the o-ring gasket. The invention is not limited in this regard.

As shown in FIG. 6, the first retaining structure 616 is advantageously comprised of a guide 622. The guide 622 ensures proper alignment of the electrical connector 200 and bottom wall 210 of the battery compartment 206 (described above in relation to FIG. 2). The guide 622 can be defined by a chamfered edge of the first retaining structure 616. The shape of the chamfered edge can be annular or any other shape selected in accordance with a particular electrical connector application. It should be noted that the guide 622 slidingly engages the guide 304 (described above in relation to FIGS. 2-3) when the electrical connector 200 is inserted into the aperture (or bored hole) 208 (described above in relation to FIGS. 2-3) of the battery compartment 206.

Referring again to FIG. 6, the gasket 620 is configured to provide an immersion seal between the electrical connector 200 and a surrounding structure (e.g., a sidewall of aperture 208 as shown in FIG. 3). The immersion seal is an environmental seal configured to prevent environmental contaminants (e.g., moisture) from seeping into the electrical connector 200. According to an embodiment of the invention, the gasket 620 is a continuous molded gasket formed of silicone rubber having a hardness between forty (40) and ninety (90) durometers. The invention is not limited in this regard. The gasket 620 can be formed of any material selected in accordance with a particular electrical connector application.

Figure 7:
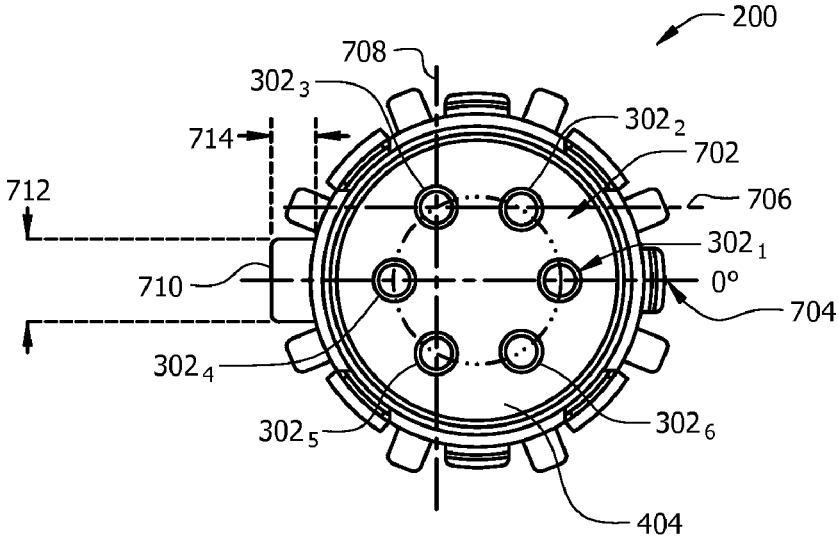
FIG. 7 is a top view of the low impedance, low-profile connector shown in FIGS. 2-3 that is useful for understanding the invention.

Referring now to FIG. 7, there is provided a top view of the electrical connector 200. As shown in FIG. 7, the electrically conductive pins 302 are arranged in a radial pattern 702. The radial pattern 702 includes numerous electrically conductive pins $\mathbf{302}_1, \ldots, \mathbf{302}_6$ equally or unequally spaced apart. For example, if the electrical connector 200 is to be used in a six (6) pin electrical connector application, then the electrical connector 200 is comprised of electrical pins $\mathbf{302}_1$, $\mathbf{302}_4$ located zero degrees (0°) from an axis line 704 and electrical pins $\mathbf{302}_2$, $\mathbf{302}_3$, $\mathbf{302}_5$, $\mathbf{302}_6$ located sixty degrees (60°) from axis line 704. Notably, horizontal axes 706 of the electrical pins $\mathbf{302}_2$, $\mathbf{302}_3$ are aligned. Similarly, horizontal axes 706 of the electrical pins $\mathbf{302}_5$, $\mathbf{302}_6$ are aligned. Vertical axes 708 of the electrical pins $\mathbf{302}_2$, $\mathbf{302}_6$ are aligned. Likewise, the vertical axes 708 of the electrical pins $\mathbf{302}_3$, $\mathbf{302}_5$ are aligned. The invention is not limited in this regard. The electrically conductive pins $\mathbf{302}_1$, $\mathbf{302}_2$, $\mathbf{302}_3$, $\mathbf{302}_5$, $\mathbf{302}_6$ can be in any arrangement selected in accordance with a particular electrical connector application.

Referring again to FIG. 7, the dielectric body 404 comprises an alignment key structure 710. The alignment key structure 710 assists in an insertion of the electrical connector 200 into the aperture (or bored hole) 208 formed in the bottom wall 210 of the battery compartment 206 (described above in relation to FIG. 2). The alignment key structure 710 selectively limits an installed position of the electrical connector 200 within a chassis in which it is to be installed. In effect, the alignment key structure 710 ensures that the electrical connector 200 is placed in a proper orientation within the aperture (or bored hole) 208. The alignment key structure 710 further ensures that the electrical connector 200 remains in a selected or optimal position within the aperture (or bored hole) 208. Stated differently, the alignment key structure 710 is provided to guarantee that each electrically conductive pin 302 engages a respective electrically conductive pad/contact of a power source (e.g., battery 202 of FIG. 2) and a circuit (not shown). The alignment key structure 710 provides a means for preventing the electrical connector 200 from rotating or spinning inside the aperture (or bored hole) 208.

The alignment key structure 710 can generally have a rectangular shape with round corners. The round corners can have a radius with a value falling within the range of 0.005 inch to 0.020 inch. The alignment key structure 710 can also have a predefined width 712 and length 714. For example, width 712 is selected to have a value falling within the range of 0.060 inch to 0.030 inch. Length 714 is selected to have a value falling within the range of 0.040 inch to 0.020 inch. The invention is not limited in this regard. The alignment key structure 710 can have any shape and dimensions selected in accordance with a particular electrical connector application.

Figure 8:
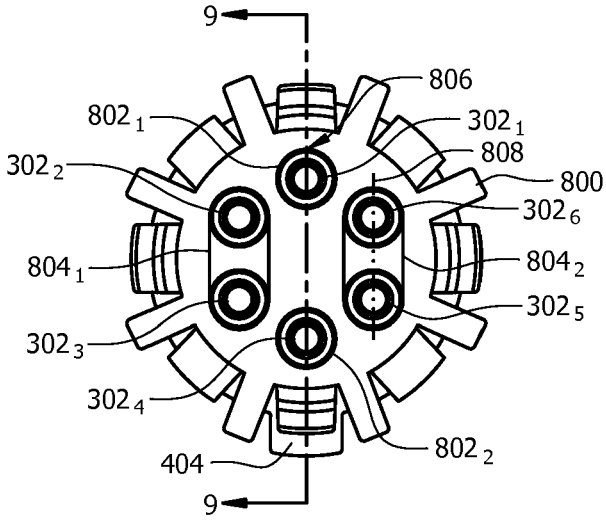
FIG. 8 is a bottom view of the low impedance, low-profile connector shown in FIGS. 2-3 that is useful for understanding the invention.

Referring now to FIG. 8, there is provided a bottom view of the electrical connector 200. As shown in FIG. 8, the electrical connector 200 is comprised of a plate 800 formed of a planar conductive material secured to the dielectric body 404 adjacent to the first surface (or face) 408 thereof. The plate 800 will be described in detail below in relation to FIG. 10. However, it should be understood that the plate 800 comprises apertures $\mathbf{802}_1$, $\mathbf{802}_2$, $\mathbf{804}_1$, $\mathbf{804}_2$ formed therethrough. The apertures $\mathbf{802}_1$, $\mathbf{802}_2$ have a generally circular shape configured for receiving the electrically conductive pins $\mathbf{302}_1$, $\mathbf{302}_4$, respectively. The axes 806 of the apertures $\mathbf{802}_1$, $\mathbf{802}_2$ are aligned in parallel. The electrically conductive pins $\mathbf{302}_1$, $\mathbf{302}_4$ extend through the apertures $\mathbf{802}_1$, $\mathbf{802}_2$ in a direction away from the surface (or face) 604 of the dielectric body 404. The apertures $\mathbf{804}_1$, $\mathbf{804}_2$ have an elongated shape configured for receiving sets of electrically conductive pins $\mathbf{302}_2$, $\mathbf{302}_3$ and $\mathbf{302}_5$, $\mathbf{302}_6$, respectively. The axes 808 of the apertures $\mathbf{804}_1$, $\mathbf{804}_2$ are perpendicularly aligned. The electrically conductive pins $\mathbf{302}_2$, $\mathbf{302}_3$, $\mathbf{302}_5$, $\mathbf{302}_6$ extend through the apertures $\mathbf{804}_1$, $\mathbf{804}_2$ in a direction away from the surface (or face) 604 of the dielectric body 404.

Figure 9:
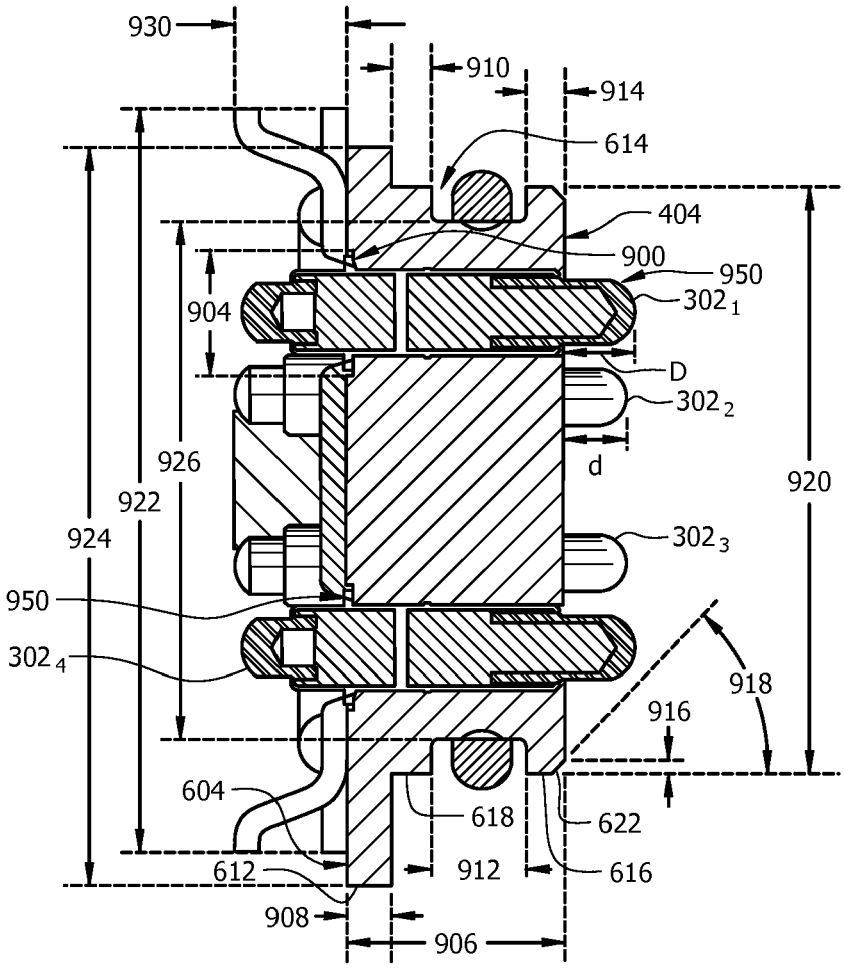
FIG. 9 is a cross-sectional view of the low impedance, low-profile connector taken along line 9-9 of FIG. 8.

Referring now to FIG. 9, there is provided a cross sectional view of the electrical connector 200 taken along line 9-9 of FIG. 8. As shown in FIG. 9, the dielectric body 404 is comprised of a surface (or face) 604 with cavities 900 formed therein. Each of the cavities has a pre-selected diameter 904 for receiving a flange 950 of an electrically conductive pin $\mathbf{302}_1$, $\mathbf{302}_2$, $\mathbf{302}_3$, $\mathbf{302}_5$, $\mathbf{302}_6$. For example, each of the diameters 904 can be selected to have a value falling within the range of 0.040 inch to 0.020 inch. The invention is not limited in this regard.

As also shown in FIG. 9, the plate 800 is advantageously designed to overlap and engage the flange 950 of at least one electrically conductive pin (e.g., electrically conductive ground pins $\mathbf{302}_1$, $\mathbf{302}_4$). Such a plate 800 design ensures that the electrically conductive pins (e.g., electrically conductive ground pins $\mathbf{302}_1$, $\mathbf{302}_4$) are securely retained within the dielectric body 404. Such a plate 800 design also ensures that the electrically conductive pins (e.g., electrically conductive ground pins $\mathbf{302}_1$, $\mathbf{302}_4$) can be coupled to a chassis (as shown in FIG. 3) for grounding the same.

It should be noted, the electrically conductive pins $\mathbf{302}_1$, $\mathbf{302}_4$ are arranged so that their ends 960 protrude a distance D from the dielectric body 404. The value of distance D is advantageously greater than the value of a distance d. Distance d is the distance in which the electrically conductive pins $\mathbf{302}_2$, $\mathbf{302}_3$ protrude from the dielectric body 404. This unequal distance configuration helps protect circuits coupled to the electrical connector 200 from electrostatic discharge (ESD). ESD is well known to those having ordinary skill in the art, and therefore will not be described herein.

Referring again to FIG. 9, the plate 800 has a pre-selected height 930 and diameter 922. According to one non-limiting embodiment of the invention, the pre-selected height 930 has a value falling within the range of 0.100 inch to 0.120 inch. The invention is not limited in this regard. The plate 800 can have any dimensions selected in accordance with a particular electrical connector application.

The dielectric body 404 is selected to have a pre-selected height 906. In one embodiment of the invention, the height 906 is selected to have a value falling within the range of 0.150 inch to 0.209 inch. The invention is not limited in this regard.

Elements 612, 614, 616, 618 of the dielectric body 404 are selected to have heights 908, 912, 914, 910 and diameters 924, 926, 920, respectively. Each of the dimensions 908, 910, 912, 914, 920, 924, 926 are selected in accordance with a particular electrical connector application. For example, in one embodiment of the invention, height 908 of protruding end 612 is selected to have a value falling within the range of 0.020 inch to 0.050 inch. Diameter 924 of protruding end 612 is selected to have a value falling within the range of 0.400 inch to 0.650 inch. Height 912 of groove 614 is selected to have a value falling within the range of 0.04 inch to 0.10 inch. Diameter 926 of groove 614 is selected to have a value falling within the range of 0.300 inch to 0.600 inch. Height 914 of retaining structure 616 is selected to have a value falling within the range of 0.020 inch to 0.050 inch. Height 910 of retaining structure 618 is selected to have a value falling within the range of 0.020 inch to 0.050 inch. Diameters 920 of retaining structures 616, 618 are selected to have a value falling within the range of 0.300 inch to 0.600 inch. The invention is not limited in this regard.

The guide 622 of the dielectric body 404 is selected to have a width 916 and a chamfered angle 918. According to a particular embodiment of the invention, the chamfered angle 918 is selected to have a value between fifteen and seventy degrees (15°-70°). The width 916 is selected to have a value falling within the range of 0.010 inch to 0.020 inch. The invention is not limited in this regard.

Figure 10:
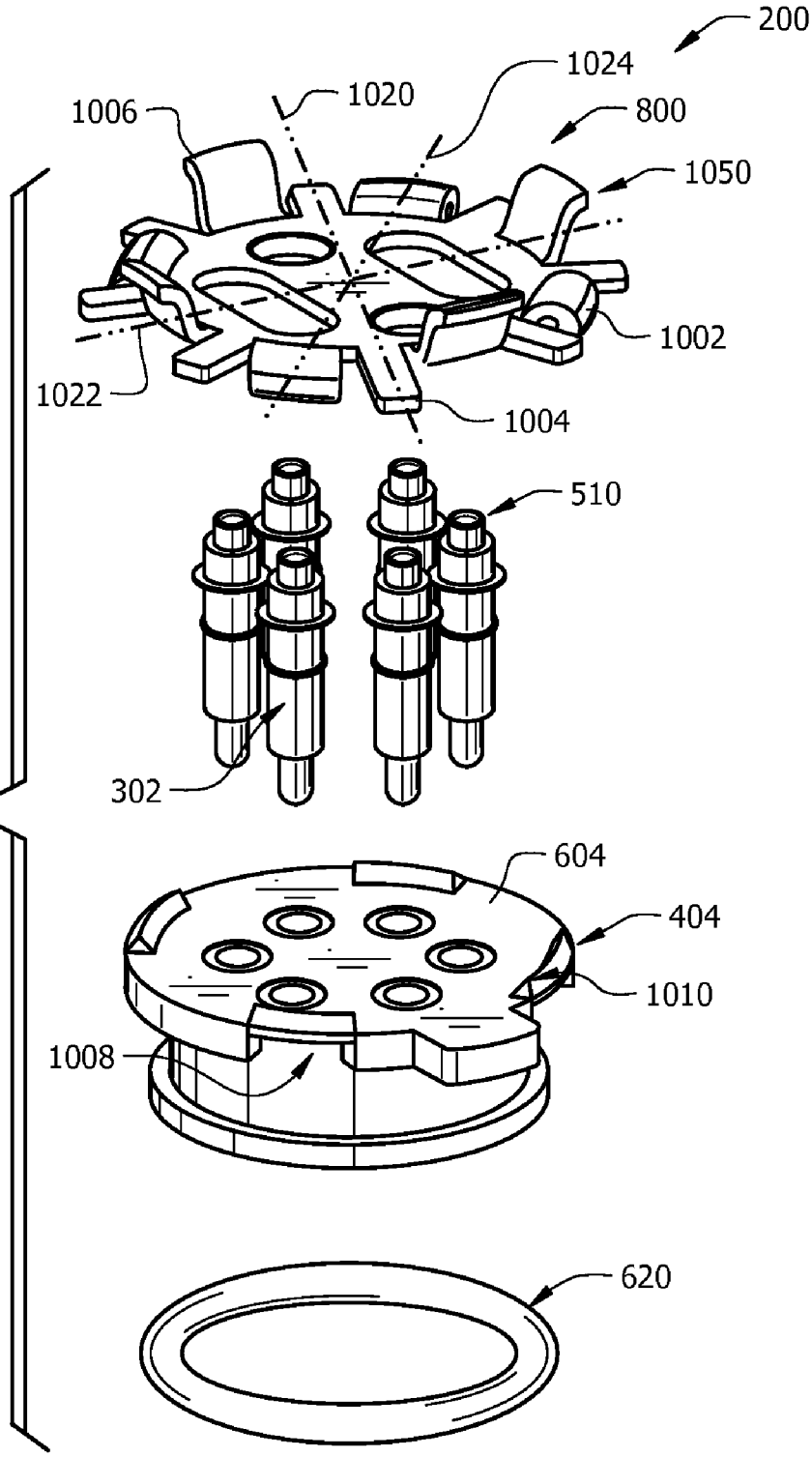
FIG. 10 is an exploded perspective view of the low impedance, low-profile connector shown in FIGS. 2-3 that is useful for understanding the invention.

Referring now to FIG. 10, there is provided an exploded perspective view of the electrical connector 200. As shown in FIG. 10, the plate 800 comprises a plurality of retention fingers 1002, retainers 1004, and resilient spring fingers 1006. Although four (4) retention fingers 1002, eight (8) retainers 1004, and four (4) resilient spring fingers 1006 are shown in FIG. 10, the invention is not limited in this regard. The plate 800 can have any number of each member 1002, 1004, 1006 selected in accordance with a particular electrical connector application.

The plate 800 is generally formed from an electrically conductive material. Such electrically conductive materials include, but are not limited to, aluminum and an aluminum-nickel composite. The plate 800 can be formed utilizing any suitable process known to those having ordinary skill in the art. Such processes include, but are not limited to, molding processes, etching processes, and machining processes.

The retention fingers 1002 are shaped to define a resilient clip configured for engaging a portion of the dielectric body 404. In particular, the retention fingers 1002 are designed to have a generally cup-shape. The retention fingers 1002 are also designed to resiliently expand and retract when pressed against the dielectric body 404. In operation, the retention fingers 1002 provide a retention force between the plate 800 and the dielectric body 404.

As shown in FIG. 10, the retention fingers 1002 are radially spaced apart along a periphery of the plate 800. For example, the retention fingers 1002 are projections respectively located along a periphery of the plate 800 at zero degrees (0°) or ninety-degrees (90°) from an axis 1024. The invention is not limited in this regard.

The retainers 1004 are configured to facilitate the retention of the electrical connector 200 within the aperture (or bored hole) 208 of the communication device 100 (as shown in FIG. 3). The retainers 1004 are also configured to secure the electrical connector 200 to a chassis. As shown in FIG. 10, the retainers 1004 are formed as tab-like projections protruding away from a periphery of the plate 800. The retainers 1004 are defined by a periphery of the plate 800. The retainers 1004 are sized and shaped to extend beyond a peripheral edge of the dielectric body 404. The retainers 1004 are radially spaced apart along a periphery of the plate 800. For example, the retainers 1004 are respectively located along a periphery of the plate 800 at zero degrees (0°), forty-five degrees (45°), or ninety-degrees (90°) from an axis 1020. The invention is not limited in this regard.

As further shown in FIG. 10, the retainers 1004 have a substantially rectangular shape with round corners. The invention is not limited in this regard. The retainers 1004 can have any shape selected in accordance with a particular electrical connector 200 application. It should be noted that the retainers 1004 are provided to facilitate an electrical connection between at least one electrically conductive pin (e.g., electrically conductive pins $\mathbf{302}_1$, $\mathbf{302}_4$) and a chassis for grounding the same.

The resilient spring fingers 1006 are provided to account for tolerance variations between the sizes of the dielectric body 404 and printed circuit boards 300 (described above in relation to FIG. 3). The resilient spring fingers 1006 are configured to facilitate the retention of the electrical connector 200 within the aperture (or bored hole) 208 of the communication device 100 (as shown in FIG. 3). As such, the resilient spring fingers 1006 are protruding structures formed on a periphery of the plate 800. Each resilient spring finger 1006 is sized and shaped so as to extend away from a plane defined by a surface (or face) 604 of the dielectric body 404 when the plate 800 is coupled thereto. Each resilient spring finger 1006 has an end 1050 distal from the dielectric body 404 when the plate 800 is coupled thereto. These distal ends 1050 can be placed along the periphery of the plate 800 so as to be approximately aligned with the nubs 510 of the electrically conductive pins 302.

As shown in FIG. 10, the resilient spring fingers 1006 have a substantially S-shaped profile. The invention is not limited in this regard. The resilient spring fingers 1006 can have any shape selected in accordance with a particular electrical connector 200 application. As also shown in FIG. 10, the resilient spring fingers 1006 are radially spaced apart along a periphery of the plate 800. For example, the resilient spring fingers 1006 are respectively located along a periphery of the plate 800 at zero degrees (0°) or ninety-degrees (90°) from an axis 1022. The invention is not limited in this regard.

It should be understood that the resilient spring fingers 1006 are also configured to provide a mechanical connection between at least one electrically conductive pin (e.g., electrically conductive pins $\mathbf{302}_1$, $\mathbf{302}_4$) and a chassis (as shown in FIG. 3). As a result of the mechanical connection, an electrically conductive pad for a ground signal of a circuit (not shown) can be connected to a chassis (as shown in FIG. 3). This mechanical connection ensures low connection impedance between the communication device 100 and a power source (e.g., battery 202 shown in FIG. 2). One can appreciate that the low impedance connection reduces radiated emissions from the power source (e.g., battery 202 shown in FIG. 2), thereby increasing a clarity of a signal received at or transmitted from the communication device 100.

Referring again to FIG. 10, the dielectric body 404 comprises slots 1008 and ridges 1010 defined on a peripheral portion thereof adjacent to a surface (or face) 604. The slots 1008 facilitate the engagement between the retention fingers 1002 of the plate 800 and the dielectric body 404. As such, the slots 1008 are sized and shaped to receive at least a portion of the retention fingers 1002.

The slots 1008 and ridges 1010 ensure that the plate 800 is placed in a proper orientation when coupled to the dielectric body 404. The slots 1008 and ridges 1010 further ensure that the plate 800 remains in a selected or optimal position in relation to the dielectric body 404. Stated differently, the slots 1008 and ridges 1010 collectively provide a means for preventing the plate 800 from rotating or spinning when coupled to the dielectric body 404.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

We claim:

1. A low impedance, low-profile connector, comprising:

a dielectric body comprising two opposing faces;

a plurality of pins formed of a conductive material captured within said dielectric body, each of said plurality of pins extending through said dielectric body and each defining a pair of nubs, each said nub extending from a respective one of said two opposing faces, each said nub movable along an axis aligned with an elongated length of said pins and resiliently biased in a direction away from said two opposing faces;

a plate formed of a planar conductive material secured to said dielectric body adjacent to a first face of said two opposing faces, said plate comprising one or more apertures through which said pins extend in a first direction, said apertures sized and shaped for establishing an electrical connection between said plate and selected ones of said pins; and a plurality of resilient spring fingers comprising projections formed on a periphery of said plate, each of said resilient spring fingers extending away from said dielectric body in a direction between a plane defined by said first face and said first direction of said pins.

2. The low-impedance, low-profile connector according to claim 1, wherein said plate is further comprised of a plurality of retention fingers formed as projections on a periphery of said plate, each of said retention fingers shaped to define a resilient clip configured for engaging a portion of said dielectric body.

3. The low-impedance, low-profile connector according to claim 2, wherein said portion of said dielectric body is a ridge defined on a peripheral portion of said dielectric body adjacent to said first face.

4. The low-impedance, low-profile connector according to claim 1, wherein said plate is further comprised of a plurality of retainers formed of tab-like projections defined on a periphery of said plate, each of said retainers extending beyond a peripheral edge of said dielectric body and configured for securing said connector to a chassis.

5. The low-impedance, low-profile connector according to claim 1, wherein said dielectric body is comprised of at least one sidewall extending from said first face to a second opposing face, and at least one gasket is provided on said at least one sidewall configured for forming a seal, which prevents the intrusion of environmental contaminants around a periphery of said connector when said connector is installed in a chassis.

6. The low-impedance, low-profile connector according to claim 1, wherein said dielectric body has a cylindrical form.

7. The low-impedance, low-profile connector according to claim 1, wherein said dielectric body is further comprised of an alignment key structure configured for selectively limiting an installed position of said connector within a chassis in which it is to be installed.

8. The low-impedance, low-profile connector according to claim 1, wherein said resilient spring fingers have an S-shaped profile.

9. The low-impedance, low-profile connector according to claim 1, wherein said selected ones of said pins that form a connection with said plate are ground pins, and said ground pins are longer in length as compared to a remainder of said plurality of pins.

10. The low-impedance, low-profile connector according to claim 1, where an end of said resilient spring fingers distal from said dielectric body is approximately aligned with an end of said nubs distal from said dielectric body.

11. A low impedance, low-profile connector, comprising:

a dielectric body comprising two opposing faces;

a plurality of pins formed of a conductive material captured within said dielectric body, each of said plurality of pins extending through said dielectric body and each defining a pair of nubs, each said nub extending from a respective one of said two opposing faces, each said nub movable along an axis aligned with an elongated length of said pins and resiliently biased in a direction away from said two opposing faces;

a plate formed of a planar conductive material secured to said dielectric body adjacent to a first face of said two opposing faces, said plate comprising one or more apertures through which said pins extend in a first direction, said apertures sized and shaped for establishing an electrical connection between said plate and selected ones of said pins; and a plurality of resilient spring fingers comprising projections formed on a periphery of said plate, each of said resilient spring fingers extending away from said dielectric body in a direction between a plane defined by said first face and said first direction of said pins;

wherein said plate is further comprised of a plurality of retention fingers formed as projections on a periphery of said plate, each of said retention fingers shaped to define a resilient clip configured for engaging a portion of said dielectric body.

12. The low-impedance, low-profile connector according to claim 11, wherein said plate is further comprised of a plurality of retainers formed of tab-like projections defined on a periphery of said plate, said retainers extending beyond a peripheral edge of said dielectric body and configured for securing said connector to a chassis.

13. The low-impedance, low-profile connector according to claim 11, wherein said dielectric body is comprised of at least one sidewall extending from said first face to a second opposing face, and at least one gasket is provided on said at least one sidewall configured for forming a seal, which prevents the intrusion of environmental contaminants around a periphery of said connector when said connector is installed in a chassis.

14. The low-impedance, low-profile connector according to claim 11, wherein said dielectric body has a cylindrical form.

15. The low-impedance, low-profile connector according to claim 11, wherein said dielectric body is further comprised of an alignment key structure configured for selectively limiting an installed position of said connector within a chassis in which it is to be installed.

16. The low-impedance, low-profile connector according to claim 11, wherein said resilient spring fingers have an S-shaped profile.

17. The low-impedance, low-profile connector according to claim 11, wherein said selected ones of said pins that form a connection with said plate are ground pins, and said ground pins are longer in length as compared to a remainder of said plurality of pins.

18. The low-impedance, low-profile connector according to claim 11, where an end of said resilient spring fingers distal from said dielectric body is approximately aligned with an end of said nubs distal from said dielectric body.

19. A low impedance, low-profile connector, comprising:

a cylindrically shaped dielectric body comprising two opposing faces;

a plurality of pins formed of a conductive material captured within said dielectric body, each of said plurality of pins extending through said dielectric body and each defining a pair of nubs, each said nub extending from a respective one of said two opposing faces, each said nub movable along an axis aligned with an elongated length of said pins and resiliently biased in a direction away from said two opposing faces;

a plate formed of a planar conductive material secured to said dielectric body adjacent to a first face of said two opposing faces, said plate comprising one or more apertures through which said pins extend in a first direction, said apertures sized and shaped for establishing an electrical connection between said plate and selected ones of said pins;

a plurality of S-shaped resilient spring fingers comprising projections formed on a periphery of said plate, each of said resilient spring fingers extending away from said dielectric body in a direction between a plane defined by said first face and said first direction of said pins;

a plurality of retention fingers formed as projections on a periphery of said plate, each of said retention fingers shaped to define a resilient clip configured for engaging a portion of said dielectric body; and a plurality of retainers formed of tab-like projections defined on a periphery of said plate, said retainers extending beyond a peripheral edge of dielectric body and configured for securing said connector to a chassis;

wherein said dielectric body is comprised of at least one sidewall extending from said first face to a second opposing face, and at least one gasket is provided on said at least one sidewall configured for forming a seal, which prevents the intrusion of environmental contaminants around a periphery of said connector when said connector is installed in a chassis.

20. A low impedance, low-profile connector, comprising:

a dielectric body comprising two opposing surfaces;

a plurality of electrically conductive pins integrated within said dielectric body so as to have a first end extending away from a first one of said opposing surfaces and a second end extending away from a second one of said opposing surfaces; and a plate formed of an electrically conductive material and comprising a plurality of retention fingers defining resilient clips configured for engaging an engagement surface of a slot formed in said dielectric body so as to have at least one surface of said plate adjacent to said first one of said opposing surfaces.

* * * * *